United States Patent [19]

Hosokoshi et al.

[11] Patent Number: 4,473,775

[45] Date of Patent: Sep. 25, 1984

[54] CATHODE-RAY TUBE DEVICE

[75] Inventors: Kakuichiro Hosokoshi; Shigeya Ashizaki; Koichi Sugawara, all of Osaka; Masao Natsuhara, Kyoto, all of Japan

[73] Assignee: Matsushita Electronics Corporation, Osaka, Japan

[21] Appl. No.: 298,993

[22] Filed: Sep. 3, 1981

[30] Foreign Application Priority Data

Sep. 11, 1980 [JP] Japan ..... 55-127406

[51] Int. Cl.[3] ..... H01J 29/46; H01J 29/56

[52] U.S. Cl. ..... 315/14; 315/382; 313/414; 313/449

[58] Field of Search ..... 315/14, 15, 370, 382, 315/31 TV, 16; 313/414, 449

[56] References Cited

U.S. PATENT DOCUMENTS 4,143,293 3/1979 Hosokoshi et al. ..... 313/414
4,319,163 3/1982 Chen ..... 315/14

FOREIGN PATENT DOCUMENTS 125816 11/1973 Japan .
54-13769 2/1979 Japan ..... 313/449

*Primary Examiner*—Theodore M. Blum
*Assistant Examiner*—Gregory C. Issing
*Attorney, Agent, or Firm*—Burgess, Ryan & Wayne

[57] ABSTRACT

An auxiliary grid which is formed with one or more elongated slits through which pass electron beams is disposed in a prefocusing system in a cathode-ray tube, and a dynamic voltage which varies in level with increase in horizontal deflection angle is applied to the auxiliary grid so that axial asymmetry of the prefocusing system can be increased with increase in the horizontal deflection angle. As a consequence, the beam spot can be maintained substantially in the form of a true circle not only at the center of the screen but also at the portions adjacent to the peripheries thereof. Thus, the resolution at the portions adjacent to the peripheries of the screen can be improved and consequently high-quality images can be represented over the whole surface of the screen.

4 Claims, 5 Drawing Figures

CATHODE-RAY TUBE DEVICE

BACKGROUND OF THE INVENTION

The present invention relates to generally a cathode-ray tube device and more particularly an electromagnetic-deflection type cathode-ray device which comprises a cathode-ray tube and its driving circuitry and which is so designed and constructed that high-quality and high-resolution images can be represented over the whole surface of a phosphor screen of the cathode-ray tube.

In the case of the color cathode-ray tube and especially in the case of the in-line type electromagnetic-deflection cathode-ray tube in which electron guns are arranged in a horizontal line, a saddle or toroidal type deflecting yoke is used so that the horizontal deflection field is distorted in the form of a pincushion while the vertical deflection field is distorted in the form of a barrel and consequently the self-convergence effect can be attained. With the saddle or toroidal type deflecting yoke, the convergence system can be much simplified. However, the spot of the electron beam (which will be referred to as the "beam spot" in this specification) is distorted from a true circle particularly at the portions adjacent to the peripheries of the phosphor screen due to the distortions of the deflection fields so that the resolution is degraded accordingly. The beam spot consists of a bright core portion and a relatively dim haze portion adjacent to the core portion. If the beam current is low and the vertical diameter of the beam spot is reduced too much, sharp moires are produced due to interference between the scanning beam and the apertures of the shadow mask.

Even in the case of an electromagnetic-deflection type monochrome cathode-ray tube, if the deflection fields are not uniform, the resolution is degraded at the portions adjacent to the peripheries of the screen.

The decrease in resolution due to the distortions of the deflection fields can be remedied by reducing the diameter of the electron beam passing through the main lens and the deflecting yoke. However, if spacing between the cathode of an electron gun and an electrostatic lens is reduced or if the prefocusing system is employed to finely focus the electron beam, the magnification of the electrostatic lens is increased excessively so that the beam spot is undesirably and unavoidably increased in diameter at the center of the screen. In order to overcome this problem, there has been devised and demonstrated a system in which the electrostatic field produced by the prefocusing system is made axially asymmetrical so that the magnification in the vertical direction can be greater than the magnification in the horizontal direction. Then, the cross section of the electron beam can be elongated in the horizontal direction so that the distortions in the vertical direction of the beam spot at the portions adjacent to the peripheries of the screen can be remedied. Since the electron beam passing through the deflecting yoke is elongated in cross section, the beam spot which appears at the portion close to the peripheries of the screen can be maintained in the form of a true circle so that moires can be avoided. However, the beam spot is elongated in the vertical direction at the center of the screen and consequently the resolution in the vertical direction is degraded. Thus, the resolution at the peripheries of the screen is improved at the sacrifice of the resolution at the center thereof.

SUMMARY OF THE INVENTION

The present invention has for its primary object to overcome the above and other problems encountered in the prior art color cathode-ray tube device.

To this and other ends, according to the present invention, an auxiliary grid which is formed with one or more elongated slits is disposed in the prefocusing system of a cathode-ray tube. A dynamic voltage which varies in level with increase in the horizontal beam deflection angle is applied to the auxiliary grid so that the axial asymmetry of the electrostatic field produced by the prefocusing system can be enhanced with increase in the beam deflection angle. As a consequence, the beam spot can be maintained substantially in the form of a true circle at the peripheries of the screen and subsequently the resolution can be improved. Thus, high-quality images can be represented over the whole surface of the screen.

The above and other objects, features and effects of the present invention will become more apparent from the following description of a preferred embodiment of the present invention in conjunction with the accompanying drawings.

DESCRIPTION OF AN EXAMPLE OF THE PRIOR ART

Figure 1:
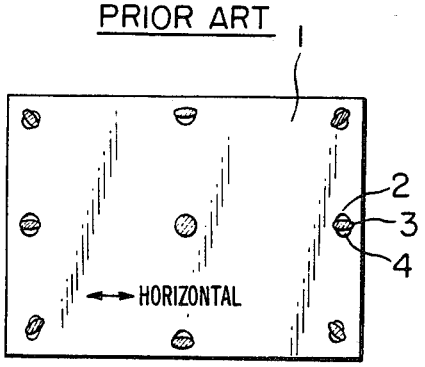
FIG. 1 PRIOR ART
FIG. 1 shows schematically distortions of beam spots on the phosphor screen of a prior art color cathode-ray tube device.

FIG. 1 shows schematically spots of electron beams focused on the phosphor screen of a prior art color cathode-ray tube. The beam spots 2 are greatly distorted from a true circle particularly adjacent to the peripheries of the screen 1 so that the resolution becomes low adjacent to the peripheries of the screen 1. The beam spot 2 consists of a bright core portion 3 in the form of a flattened ellipse accompanied with a relatively dim haze portion 4. If the vertical radius or axis of the beam spot 2 becomes too small, sharp moires are produced due to periodicity of the scanning beam and the apertures of the shadow mask.

DESCRIPTION OF THE PREFERRED EMBODIMENTS

Figure 2:
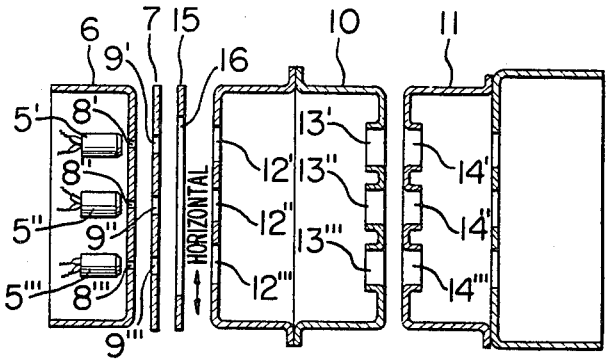
FIG. 2 is a sectional view of in-line guns of a color cathode-ray tube to which is applied the present invention.

In FIG. 2 is shown in cross section of in-line guns in accordance with the present invention. Three cathodes 5', 5'' and 5''' arranged in a horizontal line and both a control grid 6 and an accelerating grid 7 are formed with three circular apertures 8', 8'' and 8''' and 9', 9'' and 9''', respectively, to pass electron beams. A focusing grid 10 and an anode 11 which produce main bipotential lenses are formed with circular apertures 12', 12'' and 12''' and 13', 13'' and 13''' and 14', 14'' and 14''', respectively, to pass the electron beams.

Figure 3:
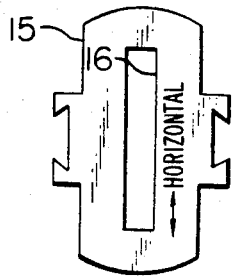
FIG. 3 is an elevation view of an auxiliary accelerating grid thereof.

An auxiliary accelerating grid 15 is interposed between the accelerating grid 7 and the focusing grid 10 and, as shown in FIG. 3, is formed with an elongated slit 16 for passing the electron beams therethrough. The minor axis of the slit 16 is about two or three times the diameter of the apertures 9', 9'' and 9''' of the accelerating grid 7. For instance, if the diameter is 0.9 mm, the vertical diameter is 2.0~3.5 mm.

Since the slit 16 is elongated in the horizontal direction, the vertical prefocusing action or effect becomes stronger than the horizontal prefocusing action or effect when a suitable accelerating voltage ($V_{g2}'$) is applied to the auxiliary accelerating grid 15. As a result, an axially asymmetric field causes the electron beams passing through the slit 16 to elongate its cross section horizontally and consequently the beam spot on the screen is elongated in the vertical direction.

If the accelerating voltage applied to the auxiliary accelerating grid 15 is equal to that ($V_{g2}$) applied to the accelerating grid 7, axial asymmetry becomes least. If the accelerating voltage $V_{g2}'$ is decreased inverse-proportionally with increase in angle of deflection in the horizontal direction of the electron beam, axial asymmetry is pronounced gradually and becomes strongest at a maximum horizontal-deflection angle. It follows, therefore, that if the accelerating voltage $V_{g2}'$ is set equal to $V_{g2}$ when the deflection angle is zero; that is, when the beam spot appears at the center of the screen and if $V_{g2}'$ is decreased gradually below $V_{g2}$ with increase in the deflection angle, the beam spot can be maintained substantially in the form of a true circle not only at the center but also adjacent to the right and left rims of the screen. As a result, deflection or spherical aberrations can be minimized and moires can be eliminated.

Figure 4:
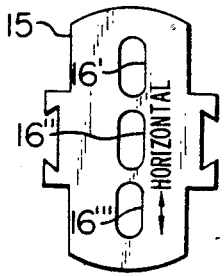
FIG. 4 shows a modification of the auxiliary accelerating grid shown in FIG. 3.

Instead of forming the single slit 16 which is common for the three electron beams, the auxiliary accelerating grid 15 can be formed with three separate vertically elongated slits 16', 16'' and 16''' as shown in FIG. 4.

Figure 5:
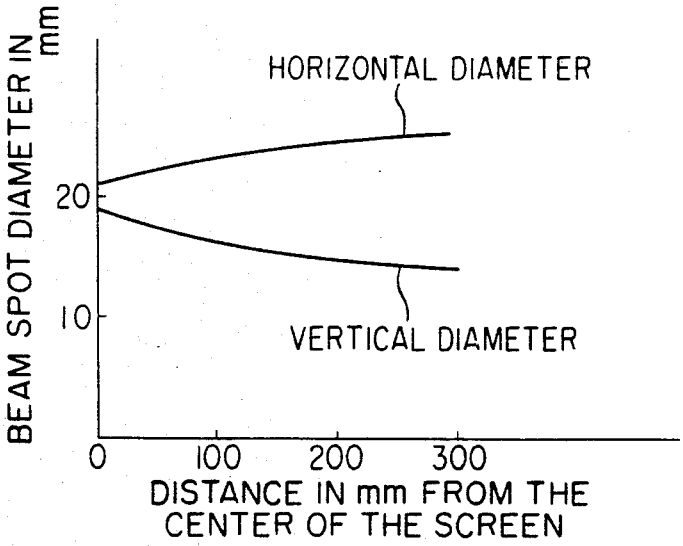
FIG. 5 is a graph illustrating the relationship between the distance from the center of the phosphor screen of a color cathode-ray tube to which is applied the present invention and the diameter of the beam spot on the screen.

In the case of a 14-inch color cathode-ray tube with a deflection angle of 90°, the focusing voltage $V_{g3}$ applied to the focusing grid 10 is about 5.8 kV and the voltage $V_a$ applied to the anode 11 is about 25 kV. In the experiments conducted by the inventors, both $V_{g3}$ and $V_a$ are set to 5.8 kV so that the beam spots on the screen can be easily observed and their diameters are measured. The results are shown in FIG. 5 in which the horizontal distance from the center of the screen is plotted along the abscissa while the diameter of the beam spot, along the ordinate. It is readily seen that the vertical diameter or axis of the beam spot is decreased with increase in deflection angle.

Such effect as described above can be also attained by placing an auxiliary focusing grid with a slit or slits in a prefocusing system instead of the auxiliary accelerating grid 15. However, the focusing voltage is extremely high so that an extremely high dynamic voltage must be applied to the auxiliary focusing grid. As a consequence, a dynamic voltage generating circuit becomes complex in construction and the problem of insulation arises.

In summary, according to the present invention, an auxiliary accelerating grid or an auxiliary focusing grid which is formed with an elongated slit or slits is disposed in a prefocusing system and the dynamic voltage applied to the auxiliary accelerating or focusing grid is decreased or increased as the beam deflection angle is increased or decreased so that axial asymmetry of the prefocusing lens or system is controlled with increase in the deflection angle. As a consequence, satisfactory resolution can be obtained over the entire surface of the screen. Thus, when the present invention is applied to a character-graphic display device in which image qualities adjacent to the periphery of the screen are critical, the reproduction of images with high quality can be ensured.

What is claimed is:

1. In a cathode-ray tube device comprising an electromagnetic beam deflection system, and a prefocusing lens system comprising in-line cathodes, a control grid having circular apertures, an accelerating grid having circular apertures, a focusing grid having circular apertures and an anode the improvement which comprises: an auxiliary grid, having at least one elongated slit having a major and a minor axis for passing an electron beam therethrough, disposed between the accelerating grid and the focusing grid wherein the major axis of the slit is arranged in-line with the in-line cathodes, and means for applying to the auxiliary grid a dynamic voltage which changes in level with an increase in the beam deflection angle, whereby axial asymmetry of the prefocusing lens system is increased in the beam deflection angle.

2. A cathode-ray tube device as set forth in claim 1 further characterized in that the minor axis of said slit or slits of said auxiliary grid is about two to three times the diameters of apertures of said accelerating grid through which pass the electron beams.

3. A cathode-ray tube device as set forth in claim 2 further characterized in that said dynamic voltage applied to said auxiliary grid is substantially equal to a voltage applied to said accelerating grid when the beam deflection angle is zero.

4. A cathode-ray tube device as set forth in claim 1 further characterized in that said dynamic voltage applied to said auxiliary grid is substantially equal to a voltage applied to said focusing grid when the beam deflection angle is zero.

* * * * *